US009512609B2

(12) United States Patent
Persson

(10) Patent No.: US 9,512,609 B2
(45) Date of Patent: Dec. 6, 2016

(54) DEVICE AND A METHOD FOR CONTROLLING A FLOW OF LIQUID

(71) Applicant: Boafallsbacke AB, Karlshamn (SE)

(72) Inventor: Mats Persson, Karlshamn (SE)

(73) Assignee: Boafallsbacke AB, Karlshamn (SE)

( * ) Notice: Subject to any disclaimer, the term of this patent is extended or adjusted under 35 U.S.C. 154(b) by 0 days.

(21) Appl. No.: 14/423,181

(22) PCT Filed: Aug. 21, 2013

(86) PCT No.: PCT/SE2013/050981
§ 371 (c)(1),
(2) Date: Feb. 23, 2015

(87) PCT Pub. No.: WO2014/035315
PCT Pub. Date: Mar. 6, 2014

(65) Prior Publication Data

US 2015/0218790 A1 Aug. 6, 2015

(30) Foreign Application Priority Data

Aug. 31, 2012 (SE) ..... 1250976-6

(51) Int. Cl.
*E03F 5/10* (2006.01)

(52) U.S. Cl.
CPC ..... *E03F 5/107* (2013.01)

(58) Field of Classification Search
CPC ..... E03F 5/107
USPC ..... 405/92–94, 96, 99–100, 125
See application file for complete search history.

(56) References Cited

U.S. PATENT DOCUMENTS 4,324,506 A * 4/1982 Steinke ..... E02B 8/045 137/217
4,877,352 A * 10/1989 Tuttle ..... G05D 9/02 405/100
5,462,075 A 10/1995 Persson

FOREIGN PATENT DOCUMENTS

SE 469898 B 10/1993

OTHER PUBLICATIONS

International Preliminary Report on Patentability from corresponding International Application No. PCT/SE2013/050981, Dated Mar. 3, 2015.
International Search Report from corresponding International Application No. PCT/SE2013/050981, Dated Nov. 27, 2013.

* cited by examiner

*Primary Examiner* — Tara M. Pinnock
(74) *Attorney, Agent, or Firm* — Tucker Ellis LLP

(57) ABSTRACT

A device (10) for controlling a flow of liquid, comprising a well (11) having an inlet tube (12) and an outlet opening (13), wherein the inlet tube (12) is arranged with an inlet opening (14) and a longitudinal axis (A), wherein the device further comprises a closing device (19) for at least partially closing the inlet opening (14), and a movable floating body (20), wherein the inlet tube (12) or the closing device (19) is operatively connected to the floating body (20) to control the closing of the inlet opening (14) by means of the closing device (19). The inlet opening (14) is arranged in an angle (a) to the outlet opening (13) of the well (11) to prevent a substantial part of the liquid from passing directly from the inlet opening (14) to the outlet opening (13) of the well (11). The invention also relates to a method for controlling a flow of liquid.

17 Claims, 4 Drawing Sheets

DEVICE AND A METHOD FOR CONTROLLING A FLOW OF LIQUID

Figure 1:
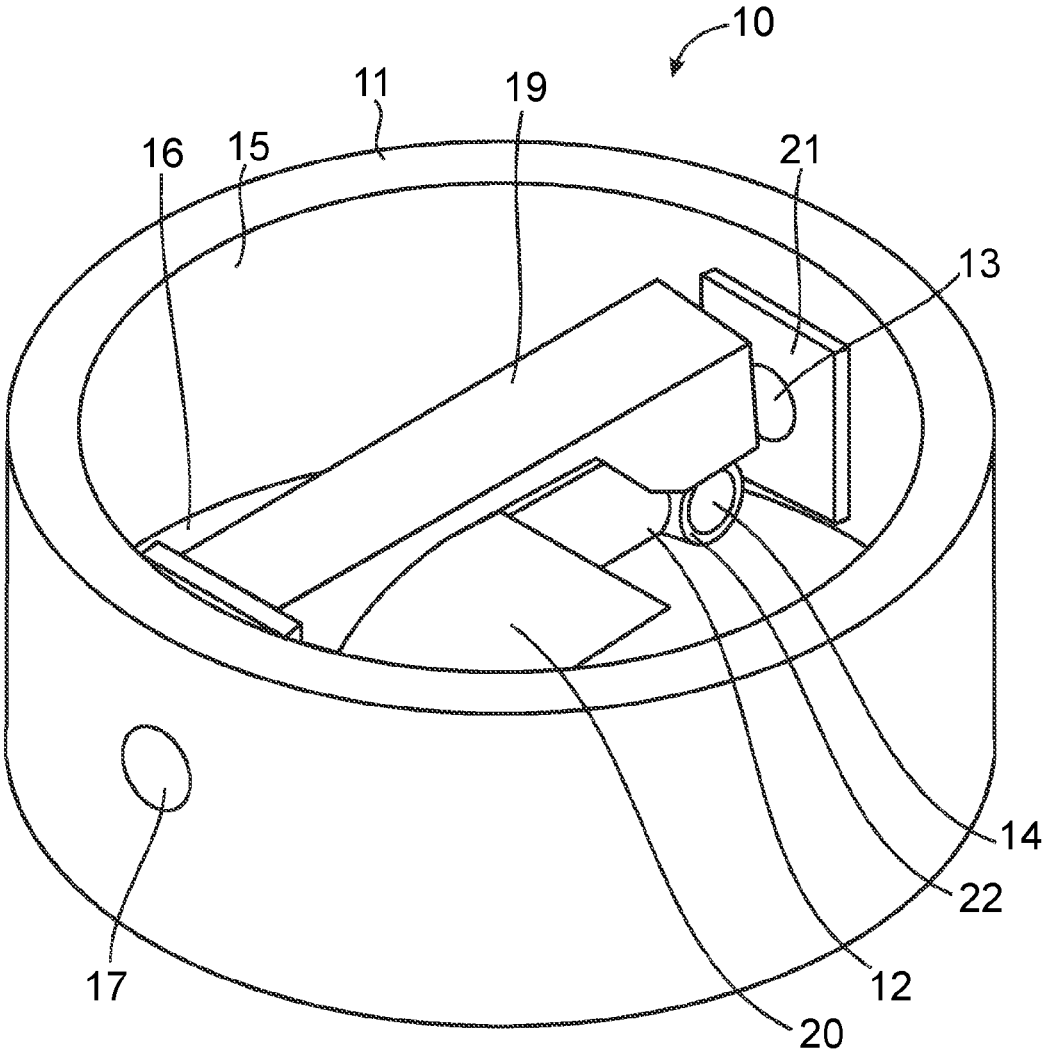

The invention relates to a device and a method for controlling a flow of liquid. This type of devices and methods are generally used for controlling flow of liquid flowing through wells, such as storm water, waste water, sewage and similar, to control flow in storm water and waste water conducts. This type of devices and methods can also be used for controlling flow to pump stations, purifying plants, oil separators, etc. The flow in conducts in, for example, a pipe system or sewerage can vary extensively due to different events, such as heavy precipitation, considerable discharges or similar. This type of devices and methods are generally used to balance a liquid flow or to redirect the liquid flow to another location, such as a reservoir, an attenuation reservoir, a dam, a natural reservoir or similar, to avoid overloading in conducts and purifying plants. This type of devices can also be used for controlling flow in watercourses, such as open watercourses. The device is, for example, a flow control well.

PRIOR ART

There are several different types of devices for controlling a flow of liquid in the prior art. One such type of device is for example disclosed in SE469898. The device disclosed in SE469898 comprises a well having an inlet tube, an outlet opening and a slide arranged above the outlet opening. The inlet tube is movably disposed around a pivot axis and is connected to a floating body. When a liquid level in the well is elevated the inlet tube is pivoted around the pivot axis by means of the floating body, wherein a mouth of the inlet tube is raised so that the mouth is closed by the slide arranged above the outlet opening of the well and the flow out from the mouth is limited.

One problem with such devices for controlling a flow of liquid according to prior art is that the structure of the devices results in an unreliable function. Consequently, there is a need for a more reliable device for controlling flow.

One drawback with such prior art devices is that they are difficult to install correctly.

Another problem with such prior art devices is that a considerable amount of sediment, gravel, sludge and debris can cumulate in the well. This can result in impaired function of the well or increased maintenance requirements. Hence, there is a need for a more cost efficient device for controlling flow of this type.

SUMMARY OF THE INVENTION

An object of the present invention is to avoid the drawbacks and problems of the prior art. The device according to the invention results in a more uniform and reliable flow control, particularly at high flow rates out from the inlet tube, while the structure simultaneously results in a device which is simple to install and which results in efficient removal of sediment, gravel, sludge and debris from the well.

The present invention relates to a device for controlling a flow of liquid, comprising a well having an inlet tube with at least one inlet opening and a longitudinal axis, and an outlet opening, a closing device for at least partially closing the inlet opening, and a movable floating body, wherein the inlet tube or the closing device is operatively connected to the floating body to control the closing of the inlet opening by means of the closing device, characterised in that the inlet opening is arranged in an angle to the outlet opening of the well to prevent a substantial part of the liquid from passing directly from the inlet opening to the outlet opening of the well. Due to that the inlet opening is arranged in an angle to the outlet opening the liquid flow is directed into the well and results in that the liquid is collected in the well before it is conducted out through the outlet opening. Hence, a more balanced flow and a more reliable flow control are provided. Due to the inlet opening being arranged in an angle to the outlet opening, the inlet opening can be arranged in a plane, which result in easier installation of the device, as the closing device interacting with the inlet opening can be designed with a flat portion for covering the inlet opening. Further, the inlet opening being arranged in an angle to the outlet opening results in a liquid flow inside the well that can remove debris, gravel, sludge and sediment therein, wherein the device is self-clearing.

Hence, the device can automatically control the flow in, for example, gravity pipes so that the overload risk is minimized. The flow can be controlled by the dimensions of the outlet opening and exact and balanced flows in gravity pipes can be obtained independent on the upstream retained water level.

The inlet tube can be provided with a first inlet opening arranged in an angle to the outlet opening of the well, and a second inlet opening arranged in an angle to the outlet opening of the well. For example, the inlet tube can be arranged as a T-shaped tube having two opposite inlet openings, wherein the inlet openings can be arranged perpendicular to the outlet opening. Hence, the inlet openings can be in their respective planes continuously, which results in simplified closing thereof. Then, the closing device can be arranged with a first closing portion for closing the first inlet opening, and a second closing portion for closing the second inlet opening. Due to the device being arranged with two inlet openings an even more balanced flow in the well can be obtained as well as a more efficient clearing of debris and sediment therein. Simultaneously, a surface of the inlet tube, such as an envelope surface, or a tube part thereof, can be arranged towards the outlet opening to efficiently prevent that a liquid flow flowing through the inlet tube with high velocity directly reaches the outlet opening without being collected in the well first.

The inlet tube can be movably arranged in the well, such as around a pivot axis, wherein the inlet tube is pivotable around the pivot axis by means of the floating body when a liquid level in the well is elevated. The pivot axis can extend in a direction perpendicular to the longitudinal axis of the inlet tube, so that the part of the inlet tube provided with the inlet openings is pivotable between a first position, in which the inlet openings are clear from the closing portions, and a second position, in which the inlet openings are covered by the closing portions. For example, the inlet openings can extend in their vertical planes, respectively, independent on the position of the inlet tube. Alternatively, the closing device can be movable I relation to the inlet tube to control closing of the inlet openings.

The well can be provided with a replaceable element having an outlet opening with optional size. Hence, a flow capacity of the well can be set in a simple manner.

The invention also relates to a method for controlling a flow of liquid, comprising the steps of a) conducting liquid to an inlet tube in a well, the inlet tube having a longitudinal axis, b) conducting the liquid to the well through the inlet tube and through an inlet opening of the inlet tube, which inlet opening is arranged in an angle to an outlet opening of the well, c) conducting liquid out from the well through the outlet opening, d) by means of a floating body, when a flow of liquid into the well exceeds a flow of liquid out from the well, bringing a closing device to at least partially close the inlet opening to limit the flow of liquid into the well, and e) when a flow of liquid into the well is below a flow of liquid out from the well, clear the inlet opening from the closing device by means of gravity.

Further characteristics and advantages of the present invention will become apparent from the description of the embodiments below, the appended drawings and the dependent claims.

SHORT DESCRIPTION OF THE DRAWINGS

Figure 2:
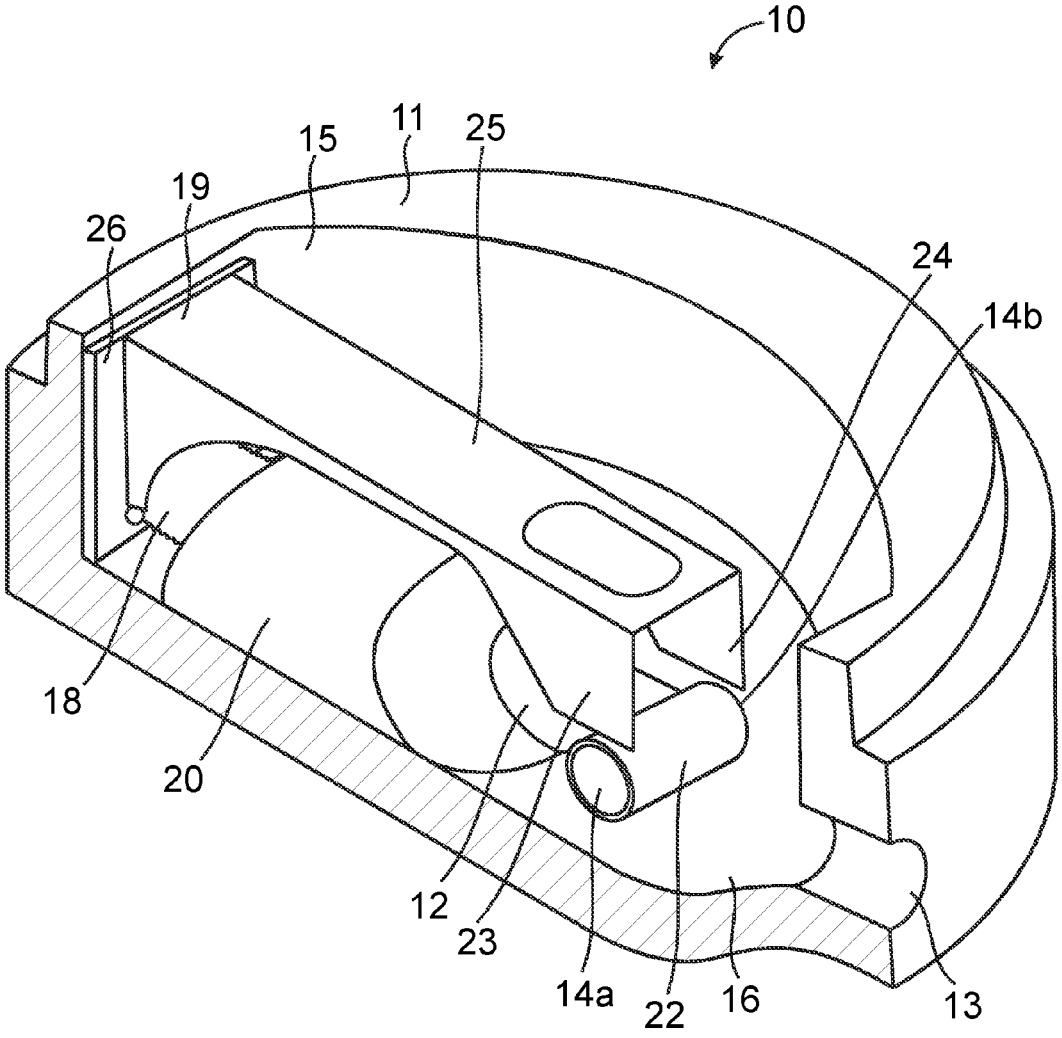
Figure 3:
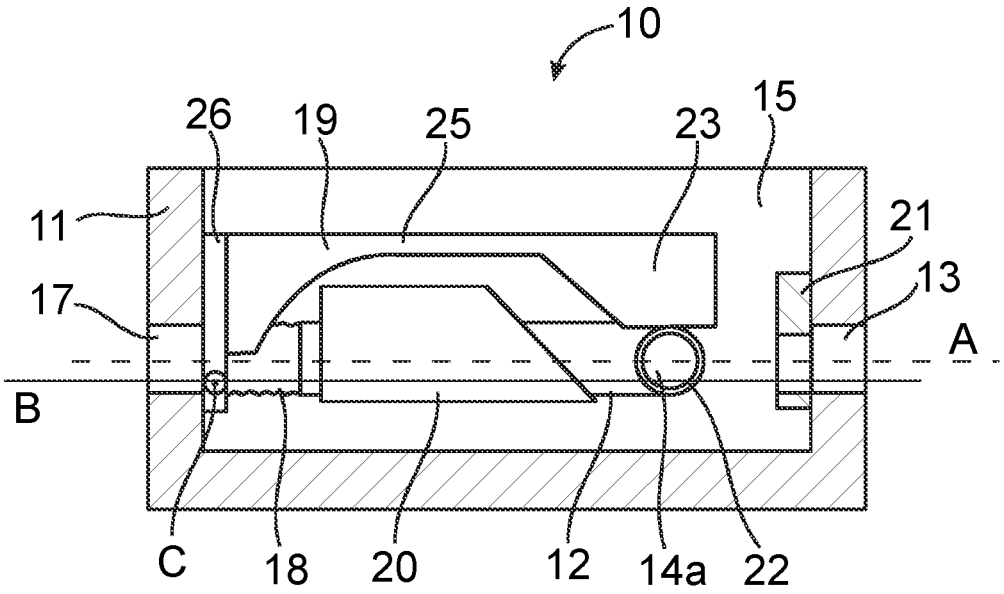
Figure 4:
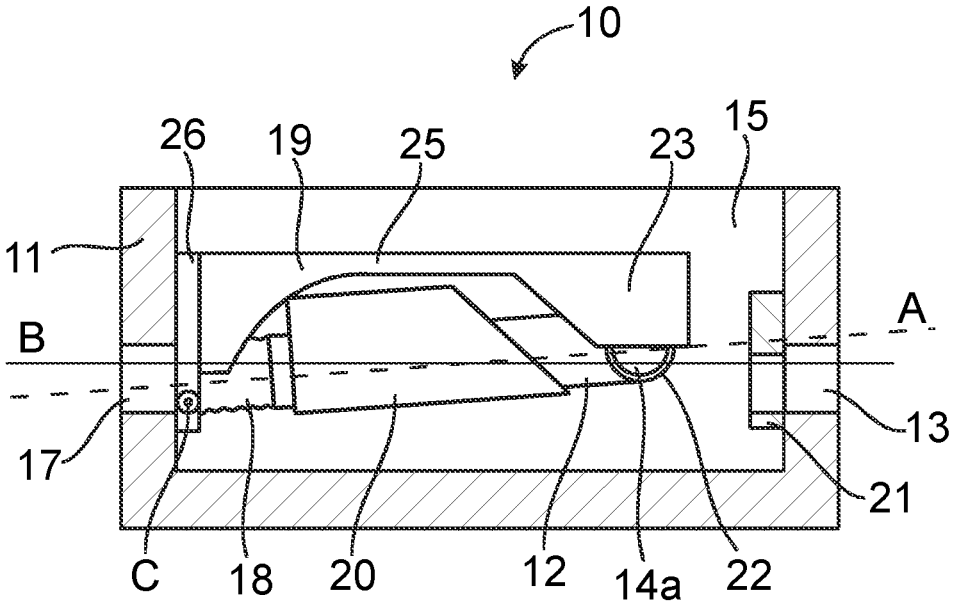
Figure 5:
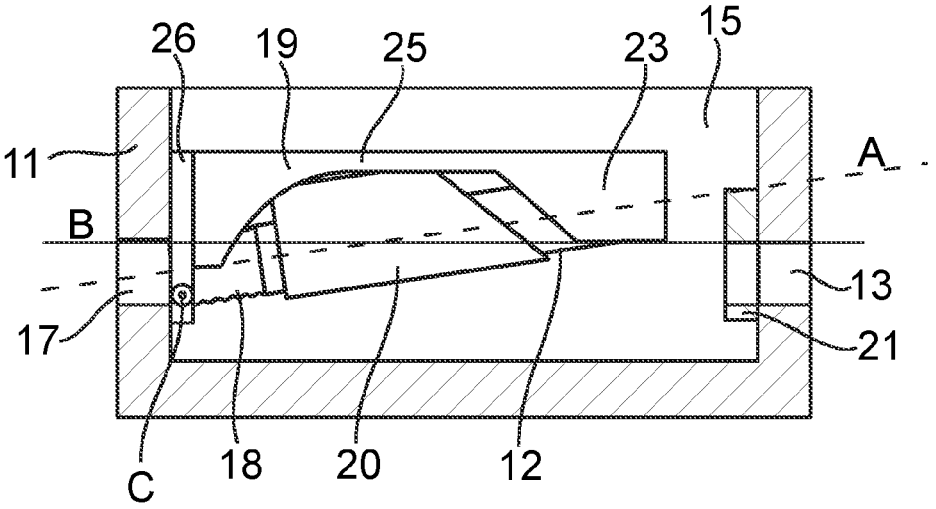
Figure 6:
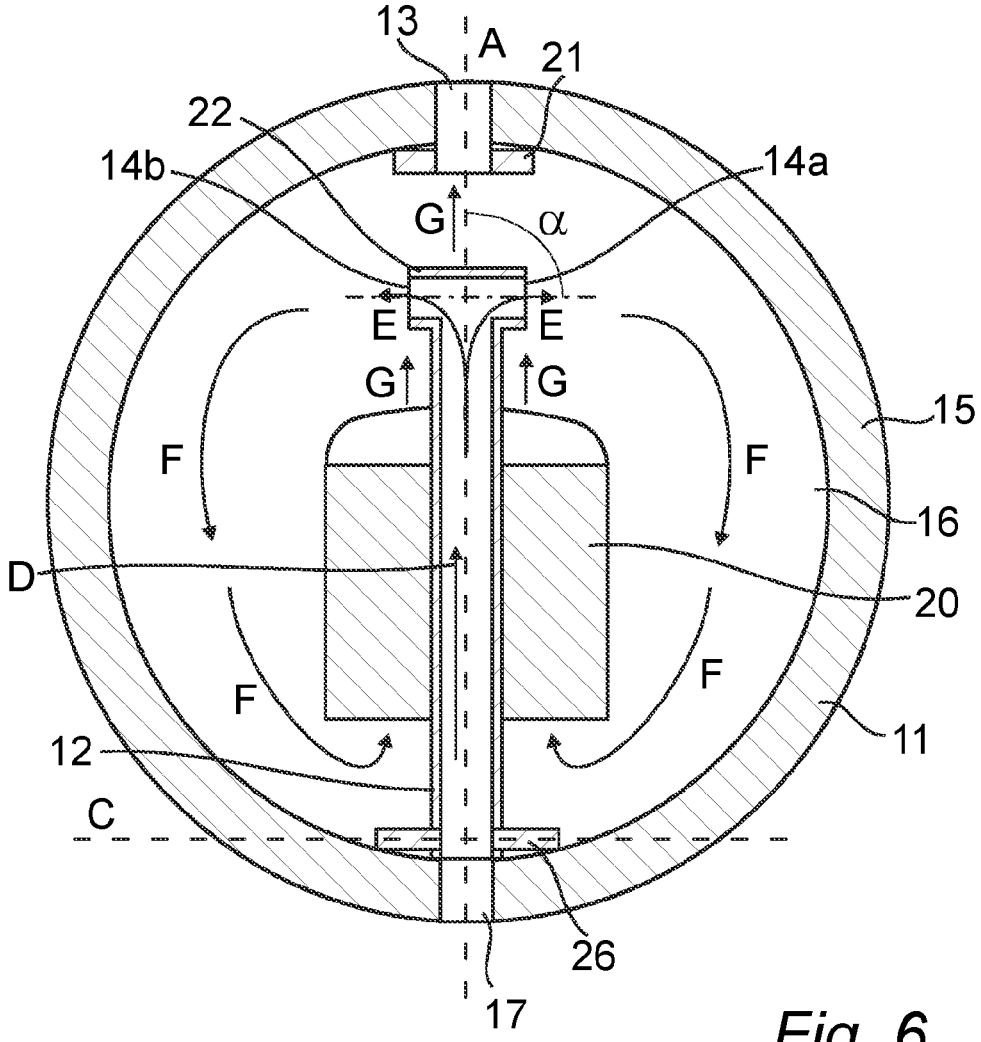

The invention will now be described more in detail with the aid of embodiments and with reference to the appended drawings, in which FIG. 1 is a schematic perspective view obliquely from above of a device for controlling a flow according to one embodiment of the present invention, showing a well, an inlet tube, a floating body and a closing device of the device, FIG. 2 is a schematic perspective view of a part of the device for controlling a flow of liquid according to one embodiment of the present invention, in which a part of the well has been removed to show the inlet tube, the floating body and the closing device arranged therein more clearly, FIG. 3 is a schematic section view from the side of the device according to FIG. 1, wherein the inlet tube is in a first position in which inlet openings of the inlet tube are clear from the closing device and liquid can flow freely to the well, FIG. 4 is a schematic view according to FIG. 3, wherein the inlet tube is in an intermediate position in which inlet openings of the tube are partially covered by means of the closing device to limit the flow of liquid to the well, FIG. 5 is a schematic view according to FIGS. 3 and 4, wherein the inlet tube is in a second position in which inlet openings of the tube are completely covered by means of the closing device to stop the flow of liquid into the well, and FIG. 6 is a schematic cross section view from above of the device according to FIG. 1, showing a flow of liquid through the inlet tube and in the well.

THE INVENTION

With reference to FIG. 1 and FIG. 2 a device 10 for controlling a flow of liquid according to one embodiment of the invention is illustrated schematically. For example, the device 10 is arranged for installation in or as part of a pipe system, such as sewerage or similar. For example, the device 10 is arranged to provide a more balanced flow to conducts, watercourses or installations, such as reservoirs, purifying plants or similar, arranged after the device 10 to prevent overload thereof.

The device 10 comprises a well 11 with an inlet tube 12 and an outlet opening 13. The well 13 is of optional type. In the illustrated embodiment the well 11 is cylindrical and arranged in a standing position. Alternatively, the well 11 is arranged in a lying position. For example, the well 11 is formed in concrete, plastic materials or any other suitable material.

The inlet tube 12 is arranged inside the well 11 and is arranged with an inlet opening 14 inside the well 11 for conducting liquid to the well 11. The inlet tube 12 extends from a wall 15 or side surface of the well 11, into the well 11 and is terminated with the inlet opening 14, so that the inlet opening 14 is arranged at a distance from the wall 15 of the well 11. In the illustrated embodiment, the inlet tube 12 extends substantially across the well 11 and along a bottom 16 of the well 11 forming a gap between a free end of the inlet tube 12 and the outlet opening 13. The inlet tube 12 is elongated and a longitudinal axis A of the inlet tube 12 extends in the illustrated embodiment in a direction towards the outlet opening 13. Alternatively, the inlet tube 12 extends in a direction towards the wall 15 and a position of the wall 15 not being provided with the outlet opening 13. The inlet tube 12 is connected to an aperture 17 in the wall 15 of the well 11. For example, the inlet tube 12 is connected to a conduct of a pipe system or similar through the aperture 17 in the wall 15 of the well 11 in a conventional manner, which is not illustrated in the drawings. In the embodiment of FIG. 2 the inlet tube 12 is connected to the wall 15 of the well 11 through a flexible sleeve 18. Alternatively, the inlet tube 12 is fixed to the wall 15. For example, the inlet tube 12 extends substantially horizontally, wherein the inlet opening 14 extends vertically. For example, the inlet tube 12 is formed with a diameter of 10-2000 mm, 25-100 mm or 50-500 mm. For example, the device is arranged for a flow from 0.1 l/s, from 0.5 l/s or from 1 l/s. For example, the device is arranged for a flow up to 1000 l/s or up to 500 l/s.

The device 10 further comprises a closing device 19 for completely or partially closing the inlet opening 14 when the liquid in the well 11 is elevated above a predetermined level, which is described in more detail below. In the illustrated embodiment the closing device 19 is fixed to the well 11, such as the wall 15 of the well 11. For example, the closing device 19 is connected to the wall of the well 11 at the inlet aperture 17 and at the wall 15 connection of the inlet tube 12. According to an alternative embodiment, which is not illustrated in the drawings, the closing device 19 is movably arranged in the well 11.

The device 10 comprises a movable floating body 20. The floating body 20 is connected to the inlet tube 12 or the closing device 19 to control closing of the inlet opening 14 by means of the closing device 19. In the illustrated embodiment the floating body 20 is connected to the inlet tube 12, wherein the inlet tube 12, or a part thereof having the inlet opening 14, is movably arranged, so that the floating body 20 can bring the inlet tube 12 to interact with the closing device 19. Alternatively, the floating body 20 is connected to the closing device 19, wherein the closing device 19 is movably arranged, so that the floating body 20 can bring the floating body 19 to interact with the inlet tube 12.

According to one embodiment the device 10 comprises a replaceable element 21 having an outlet opening 13 of optional size for setting a flow capacity of the well 11. For example, the element 21 is a plate of suitable material, such as rubber, plastic, metal or similar, provided with the outlet opening 21. For example, the element 21 is replaceable according to the application or current requirement. According to one embodiment, the element 21 can be sealed, wherein the element 21 only can be replaced by authorized personnel. For example, the outlet opening 13 is formed with a diameter of 10-2000 mm, 25-1000 mm or 50-500 mm.

The device 10 is arranged to prevent the liquid or a substantial part thereof from passing directly from the inlet opening 14 to the outlet opening 13 of the well 11. For example, the device 10 is arranged for directing the flow of liquid around in the well 11 before it reaches the outlet opening 13. The inlet opening 14 is arranged in an angle to the outlet opening 13 to prevent the liquid, or a substantial portion thereof, from passing directly from the inlet opening 14 to the outlet opening 13. In the illustrated embodiment a tube portion 22 of the inlet tube 12 with the inlet opening 14 is arranged in an angle to the outlet opening 13, so that liquid flowing from the inlet opening 14 and into the well 11 is directed towards a position of the wall 15 of the well 11 arranged at a distance from the outlet opening 13. For example, the tube portion 22 is arranged perpendicular to the longitudinal axis A of the inlet tube, wherein the inlet opening 14 is arranged perpendicular to the outlet opening 13 and an outer surface, such as an envelope surface, of the tube portion 22 is arranged towards the outlet opening 13.

In the illustrated embodiment the inlet tube 12 is arranged with a first inlet opening 14*a* and a second inlet opening 14*b*. The first inlet opening 14*a* is arranged in an angle to the outlet opening 13. The second inlet opening 14*b* is arranged in an angle to the first inlet opening 14*a* and in an angle to the outlet opening 13. In the illustrated embodiment the inlet tube 12 is arranged as a T-pipe, wherein the tube portion 22 is arranged perpendicular to the longitudinal axis A of the inlet tube 12. Hence, the inlet openings 14*a*, 14*b* are arranged opposite to each other, wherein an outer surface of the tube portion 22 is arranged towards the outlet opening 13. The inlet openings 14*a*, 14*b*, respectively, extend in a plane, such as a vertical plane.

As evident from FIG. 2 the closing device 19 is arranged with a first closing portion 23 for closing the first inlet opening 14*a*, and a second closing portion 24 for closing the second inlet opening 14*b*. The closing portions 23, 24 are connected to, such as fixed to, the wall 15 of the well 11 through an arm 25. In the illustrated embodiment the arm 25 extends along the inlet tube 12 and is, for example, arranged horizontally. The closing portions 23, 24 are arranged in an angle to the arm 25, such as perpendicular, so that the closing portions 23, 24 extend in the same direction as the inlet openings 14*a*, 14*b* or in a vertical plane at the inlet openings 14*a*, 14*b*. The first closing portion 23 is arranged at a distance from the second closing portion 24 forming a gap between them for receiving the part of the inlet tube 12 having the inlet openings 14*a*, 14*b*, such as the tube portion 22, while simultaneously covering or closing the inlet openings 14*a*, 14*b*. For example, the closing device 19 is formed in sheet metal or similar, wherein the closing portions 23, 24 are flat, level and arranged with a surface being larger than an area of the inlet openings 14*a*, 14*b*.

FIGS. 3-5 are a series of drawings disclosing closing of the inlet openings 14*a*, 14*b* by means of the closing device 19 when a liquid level in the well 11 is elevated. The liquid level in the well 11 is illustrated in FIGS. 3-5 by means of the line B. In FIG. 3 the inlet tube 12 is illustrated in a first position in which the inlet openings 14*a*, 14*b* are clear from the closing portions 23, 24 of the closing device 19. Hence, liquid can flow through the aperture 17 in the well 11, through the inlet tube 12 and out through the inlet openings 14*a*, 14*b* into the well 11 without being obstructed by the closing portions 23, 24 and subsequently flow out through the outlet opening 13.

In the embodiment of FIG. 3 the inlet tube 12 and the closing device 19 are connected to a fastener 26, such as a mounting plate, for fastening to the wall 15 of the well 11. The fastener 26 is arranged for quick and simple installation of the inlet tube 12 and the closing device 19 in the well 11. The closing device 19 is fixed to the fastener 26, wherein the arm 25 extends from the fastener 26 and extends above the inlet tube 12, wherein the closing portions 23, 24 extend downward from the arm 25 and are arranged above the inlet openings 14*a*, 14*b*.

In the illustrated embodiment the aperture 17 in the wall 15 of the well 11, a substantial part of the inlet tube 12 and the outlet opening 13 are arranged along the longitudinal axis A of the inlet tube 12 when the inlet tube 12 is in the first position.

The inlet tube 12 is movable around a pivot axis C. For example, the inlet tube 12 is connected to the well 11, such as the wall 15 of the well, through the pivot axis C. In the illustrated embodiment the inlet tube 12 is connected to the fastener 26 through the pivot axis C. For example, the pivot axis C is formed by a conventional hinge or by an inherent flexibility of the flexible sleeve 18. The pivot axis C is arranged in one end of the inlet tube 12 by the wall 15 in the well 11, i.e. in the end opposite the end of the inlet tube 12 being provided with the inlet openings 14*a*, 14*b*. Hence, at least the part of the inlet tube 12 provided with the inlet openings 14*a*, 14*b* is movable around the pivot axis C. The pivot axis C extends in a horizontal plane, perpendicular to the longitudinal axis A of the inlet tube 12.

The floating body 20 is connected to the inlet tube 12. For example, the floating body 20 encloses a portion of the inlet tube 12, such as an intermediate portion thereof, wherein the floating body 20 is formed with a recess for receiving the inlet tube 12. The floating body 20 is formed with a density being lower than the density of water to be able to float in the liquid the well 11 is intended for and to be able to raise the free end of the inlet tube 12. For example, the floating body 20 is formed in expanded plastic or in another suitable manner, such as a container filled with air or similar.

Referring to FIG. 4 an elevated liquid level B in the well 11 is illustrated, wherein the elevated liquid level B has forced the floating body 20 upwards while bringing along therewith the inlet tube 12 around the pivot axis C to an intermediate position in which the closing portions 23, 24 of the closing device 19 partially cover the inlet openings 14*a*, 14*b*. The inlet tube 12 still communicates with the aperture 17 in the well 11, wherein liquid flows in through the aperture 17, through the inlet tube 12 and into the well through the inlet openings 14*a*, 14*b*. Due to that the closing device 19 partially closes the inlet openings 14*a*, 14*b* the flow into the well 11 can be reduced in relation to when the inlet tube 12 is in its first position, as illustrated in FIG. 3. Hence, in FIG. 4 the inlet tube 12, or the part thereof provided with the inlet openings 14*a*, 14*b*, has been turned upwards around the pivot axis C, so that the longitudinal axis A of the inlet tube 12 has been turned upwards in a vertical plane and so that the inlet openings 14*a*, 14*b* have been positioned higher up in the well 11 in relation to when the inlet tube 12 is in the first position. For example, the inlet openings 14*a*, 14*b* have been displaced upwards in their vertical planes, respectively. Simultaneously, the end of the inlet tube 12 provided with the inlet openings 14*a*, 14*b*, or the tube part 22, is received in the gap between the closing portions 23, 24, so that the closing portions 23, 24 partially enclose the end of the inlet tube 12 provided with the inlet openings 14*a*, 14*b* and partially overlap and cover the inlet openings 14*a*, 14*b*.

Referring to FIG. 5 a further elevated liquid level B in the well 11 is illustrated, wherein the elevated liquid level B has forced the floating body 20 further upwards while bringing along therewith the inlet tube 12 around the pivot axis C to a second position in which the closing portions 23, 24 of the closing device 19 completely cover the inlet openings 14*a*,

14*b* to stop the flow of liquid through them. Hence, the inlet openings 14*a*, 14*b* have been displaced further upwards in their vertical planes. The inlet tube 12 still communicates with the aperture 17 in the well 11, wherein liquid flows into the aperture 17 and through the inlet tube 12 but is stopped by the closing device 19 from entering the well 11 through the inlet openings 14*a*, 14*b*. Due to that the closing device 19 entirely closes the inlet openings 14*a*, 14*b* the flow into the well 11 can be stopped until the liquid level B in the well 11 has been lowered to a lower level. In FIG. 5 the end of the inlet tube 12 provided with the inlet openings 14*a*, 14*b*, or the tube portion 22, is completely received in the gap between the closing portions 23, 24, so that the closing portions 23, 24 completely cover the inlet openings 14*a*, 14*b*. When the liquid level B in the well 11 is lowered due to the flow of liquid out through the outlet opening 13 this will result in a lowering of the inlet tube 12 by means of gravity. Hence, the inlet tube 12 is lowered when the liquid level B is lowered, wherein the flow of liquid is controlled in a reliable and favorable manner.

For example, the device 10 is arranged for controlling a size of the inlet openings 14*a*, 14*b* by means of the liquid level in the well 11. When a maximum flow through the well 11 is reached the flow into the well 11 is gradually reduced, so that a maximum level in the well 11 is maintained and the flow out from the well 11 is what it has been dimensioned for independent of retained liquid or liquid level upstream from the device 10.

Referring to FIG. 6 the device 10 is illustrated schematically seen from above. In FIG. 6 is also illustrated an imagined flow of liquid through the device 10 according to one embodiment. An incoming flow of liquid passes through the aperture 17 in the wall 15 of the well 11, into the inlet tube 12 and through a substantial portion thereof in a direction corresponding to the longitudinal axis A of the inlet tube 12, which is illustrated by means of the arrow D. The inlet openings 14*a*, 14*b* are arranged in an angle $\alpha$ to the outlet opening 13 or an extension of the longitudinal axis A of the inlet tube 12. For example, the angle $\alpha$ extends in a horizontal plane. For example, the angle $\alpha$ is larger than 30 degrees, suitably larger than 60 degrees and, for example, 90 degrees or more. Due to that the inlet openings 14*a*, 14*b* are arranged in the angle $\alpha$ to the outlet opening 13, such as perpendicular, the flow of liquid is directed out from the inlet tube 12 in a direction corresponding to the angle $\alpha$, such as perpendicular to the direction of the longitudinal axis A, which is illustrated by means of the arrows E in FIG. 6. Hence, the flow of liquid is directed out from each of the sides of the inlet tube 12 forming a first flow and a second flow. Then, at least a substantial part of the first and second flows are forced along the wall 15 of the well 11, wherein the first flow is directed along one part of the wall 15 of the well 11 and the second flow is directed along the opposite part of the wall of the well 11, which is illustrated by means of the arrows F in FIG. 6. The first and second flows are joined, for example in a middle portion of the well or in a portion of the well 11 in which the inlet tube 12 is connected to the wall 15, and directed substantially along the longitudinal axis A of the inlet tube 12 and out through the outlet opening 13, which is illustrated by means of the arrow G in FIG. 6. Hence, the device 10 is arranged for providing a flow around the well 11, such as two opposite and partially circular flows, which result in a balanced flow out from the well 11 while debris, gravel, sludge and sediment in the well 11 simultaneously is cleared out. A part of the flow, such as a minor part, can take a direction towards the outlet opening 13 when exiting the inlet openings 14*a*, 14*b*, which is not illustrated in the drawings.

For example, the device 10 is arranged without any level deviations between the inlet aperture 17 in the well 11 and the outlet opening 13 and, for example, lacks a sand trap, which makes it suitable for controlling both storm water and waste water flows. Hence, the inlet aperture 17 and the outlet opening 13 are, for example, arranged at the same level, such as along the longitudinal axis A of the inlet tube 12 when the inlet tube 12 is in the first position. Alternatively, the outlet opening 13 is arranged at a level below the inlet aperture 17 or somewhat above the inlet aperture 17.

The invention has been described by embodiment examples. It is however clear for a person skilled in the art that features of the invention can be changed within the scope of the following claims. For example, the closing device can be provided with a pivot axis at a distance from the wall 15, such as in an intermediate portion of the arm 25, wherein the closing portions can be forced downward around the pivot axis by means of the floating body 20 to close the inlet openings 14*a*, 14*b*. According to yet another alternative embodiment of the invention the outlet opening 13 of the well 11 is arranged in an angle to the aperture 17 in the wall of the well or in an angle to the longitudinal axis A of the inlet tube 12, wherein an angle of the inlet openings 14*a*, 14*b* in relation to the outlet opening 13 can be adapted to obtain a suitable flow through the well 11. According to yet another alternative embodiment the inlet openings 14*a*, 14*b* are arranged in any suitable angle in relation to the outlet opening, such as in an angle larger than 90 degrees to direct the flow from the inlet openings 14*a*, 14*b* backwards or obliquely backwards.

The invention claimed is:

1. A device for controlling a flow of liquid, comprising:

a well having an inlet tube and an outlet opening, wherein the inlet tube is arranged with an inlet opening and a longitudinal axis, a closing device for at least partially closing the inlet opening, and a movable floating body, wherein the inlet tube or the closing device is operatively connected to the floating body to control the closing of the inlet opening by means of the closing device, wherein the inlet opening is arranged in an angle to the outlet opening of the well to prevent a substantial part of the liquid from passing directly from the inlet opening to the outlet opening of the well, and wherein the inlet tube is formed with a first inlet opening arranged in an angle to the outlet opening of the well, and a second inlet opening arranged in an angle to the outlet opening of the well, and wherein the closing device is formed with a first closing portion for closing the first inlet opening and a second closing portion for closing the second inlet opening.

2. The device according to claim 1, wherein the angle extends at least partially horizontally.

3. The device according to claim 2, wherein the angle extends in a horizontal plane.

4. The device according to claim 1, wherein the inlet tube is formed with a tube portion having the inlet openings and extending in an angle to the outlet opening.

5. The device according to claim 4, wherein an outer surface of the tube portion is arranged in a direction towards the outlet opening of the well.

6. The device according to claim 5, wherein the tube portion extends in a direction perpendicular to the longitudinal axis of the inlet tube and wherein the inlet openings are arranged in opposite ends of the tube portion.

7. The device according to claim 1, wherein the inlet tube is connected to the floating body and is movable around a pivot axis.

8. The device according to claim 7, wherein the pivot axis extends in a direction perpendicular to the longitudinal axis of the inlet tube and wherein at least a part of the inlet tube comprising the inlet opening is pivotable around the pivot axis between a first position, in which the inlet opening is clear from the closing device, and a second position, in which the inlet opening is covered by the closing device.

9. The device according to claim 8, wherein the pivot axis extends horizontally or substantially horizontally, so that the inlet tube is pivotable in a vertical direction or in a vertical plane.

10. A method for controlling a flow of liquid, comprising the steps of a) conducting liquid to an inlet tube in a well, the inlet tube having a longitudinal axis, b) conducting the liquid to the well through the inlet tube and through an inlet opening of the inlet tube, which inlet opening is arranged in an angle to an outlet opening of the well, c) conducting liquid out from the well through the outlet opening, d) by means of a floating body, when a flow of liquid into the well exceeds a flow of liquid out from the well, bringing a closing device to at least partially close the inlet opening to limit the flow of liquid into the well, and e) when a flow of liquid into the well is below a flow of liquid out from the well, clear the inlet opening from the closing device by means of gravity, and wherein in step b) conducting the liquid to the well through a first inlet opening arranged in an angle to the outlet opening of the well, and a second inlet opening arranged in an angle to the first inlet opening and in an angle to the outlet opening of the well.

11. The method according to claim 10, comprising the step of, in step b), conducting the liquid to the well through the inlet opening in an angle extending horizontally or in a horizontal plane to the outlet opening.

12. The method according to claim 10, comprising the step of in step d) bringing a first closing portion to at least partially cover the first inlet opening and a second closing portion to at least partially cover den second inlet opening.

13. The method according to claim 12, comprising the steps of in step d) by means of the floating body bringing at least a portion of the inlet tube with the inlet openings to pivot around a pivot axis from a first position, in which the inlet openings are clear from the closing portions, to a second position, in which the inlet openings are at least partially covered by the closing portions.

14. The method according to claim 13, comprising the step of, in step b), conducting the liquid through a tube part extending perpendicular to a longitudinal axis of the inlet tube, and further out through the first inlet opening and the second inlet opening.

15. A device for controlling a flow of liquid, comprising a well having an inlet tube and an outlet opening, wherein the inlet tube is arranged with an inlet opening and a longitudinal axis, a closing device for at least partially closing the inlet opening, and a movable floating body, wherein the inlet tube or the closing device is operatively connected to the floating body to control the closing of the inlet opening by means of the closing device, wherein the inlet opening is arranged in an angle to the outlet opening of the well to prevent a substantial part of the liquid from passing directly from the inlet opening to the outlet opening of the well, and wherein the inlet tube is connected to the floating body and is movable around a pivot axis.

16. The device according to claim 15, wherein the pivot axis extends in a direction perpendicular to the longitudinal axis of the inlet tube and wherein at least a part of the inlet tube comprising the inlet opening is pivotable around the pivot axis between a first position, in which the inlet opening is clear from the closing device, and a second position, in which the inlet opening is covered by the closing device.

17. The device according to claim 16, wherein the pivot axis extends horizontally or substantially horizontally, so that the inlet tube is pivotable in a vertical direction or in a vertical plane.

* * * * *